United States Patent [19]

Andersson

[11] Patent Number: 4,619,734

[45] Date of Patent: Oct. 28, 1986

[54] SANITARY PAPER WEB HAVING HIGH BULK, BULK SOFTNESS AND SURFACE SOFTNESS AND METHOD OF MANUFACTURING SAID WEB

[75] Inventor: Ingmar A. Andersson, Hammarö, Sweden

[73] Assignee: KMW Aktiebolag, Karlstad, Sweden

[21] Appl. No.: 727,246

[22] PCT Filed: Oct. 16, 1984

[86] PCT No.: PCT/SE84/00339

§ 371 Date: Apr. 24, 1985

§ 102(e) Date: Apr. 24, 1985

[87] PCT Pub. No.: WO85/01761

PCT Pub. Date: Apr. 25, 1985

[30] Foreign Application Priority Data

Oct. 21, 1983 [SE] Sweden ..... 8305797

[51] Int. Cl.[4] ..... D21H 5/24

[52] U.S. Cl. ..... 162/111; 162/112; 162/113; 162/123; 162/124; 162/125; 162/127; 162/129; 162/164.1; 162/168.1; 162/169; 428/153; 428/154; 428/327

[58] Field of Search ..... 162/111, 112, 123, 124, 162/113, 125, 127, 129, 130, 132, 164.1, 168.1, 169, 168.2, 164.6, 207, 206, 205; 428/327, 153, 154

[56] References Cited

U.S. PATENT DOCUMENTS

| | | | |
|---|---|---|---|
| 3,293,114 | 12/1966 | Kenaga et al. | 162/169 |
| 3,556,934 | 1/1971 | Meyer | 162/169 |
| 3,941,634 | 3/1976 | Nisser et al. | 162/124 |

FOREIGN PATENT DOCUMENTS

| | | |
|---|---|---|
| 1311556 | 3/1973 | United Kingdom . |
| 2024886 | 1/1980 | United Kingdom . |

*Primary Examiner*—Peter Chin

*Attorney, Agent, or Firm*—Bell, Seltzer, Park & Gibson

[57] ABSTRACT

In order to achieve a sanitary paper web having high bulk, bulk softness and surface softness it is proposed according to the invention that said web contains expanded microspheres (11) of thermoplastic material in an amount of from 1 to 10% based on the weight of the dry web.

12 Claims, 2 Drawing Figures

SANITARY PAPER WEB HAVING HIGH BULK, BULK SOFTNESS AND SURFACE SOFTNESS AND METHOD OF MANUFACTURING SAID WEB

The present invention relates to a sanitary paper web having high bulk, bulk softness and surface softness and to a method of manufacturing said web.

Various types of sanitary paper are manufactured from sanitary paper webs, the term "sanitary paper" in substantial referring to the qualities usually known in the branch as "towel" and "tissue", both "toilet tissue", i.e. creped toilet paper, and "facial tissue".

The expression "bulk" refers, as usual to volume per unit weight, i.e. inverted density, and a digital value of the bulk is obtained by dividing the thickness of the web by its weight per unit area. To ensure correct thickness values, a standard contact pressure for the measuring device in the case of sanitary paper, i.e. paper having high bulk, of only 0.2 $N/cm^2$ as compared with 10 $N/cm^2$ for paper with low bulk, e.g. newspaper.

"Bulk softness" refers to the feeling of softness perceived when a sample of the paper web is crumpled between the hands. As distinct from this, "surface softness" refers to the feeling of softness perceived when the fingertips are lightly brushed over the surface of the paper web.

Many process-technical measures have been suggested with the object of improving the properties of sanitary paper, e.g. in order to obtain increased bulk, bulk softness and surface softness. Increased bulk softness can generally be obtained by treating the paper web so that bonds between the fibers are torn and broken. Thus, creping a paper web within only selected, spaced surface areas with the aid of a serrated creping blade has been proposed, or creping from a cylinder having grooves in the circumferential direction thereof. However, this method results in the occurrence of weaker lines such that the strength of the finished sheet in some directions will be reduced. Chemical additives have also been proposed. However, these are known to be difficult to apply on the formed sheet and require the use of bath or spray and the extra equipment necessitated thereby. Surface active agents have been mixed into the stock, but the resultant product has not been particularly soften, although its absorption capacity has increased. The patent literature is extremely extensive with respect to suggestions for achieving improved sanitary paper products and improved apparatuses and processes for manufacturing them. The following offers only a small selection.

A basic measure for achieving a soft tissue with low density is to avoid compacting the sanitary paper web. U.S. Pat. No. 3,812,000 describes an apparatus which avoids mechanical compacting of the paper web before it has been dried to a dryness content of about 80%, the paper web being allowed to pass a rotating blow-through dryer located upstream of the Yankee cylinder or other creping cylinder. However, the almost dry paper web does not then adhere to the Yankee cylinder in the desired manner and a creping binding agent must therefore be applied on the surface of the paper web or on the cylinder.

U.S. Pat. No. 3,301,746 suggests compacting the paper web only in spaced-apart areas by means of a specially designed embossing wire effecting impressions in the paper web during its contact with the wire. The paper web thus embossed is then creped by means of a doctor blade when the paper web leaves the Yankee cylinder. Regulating the embossing and creping pattern in connection therewith enables the bulk softness and bulk of the finished product to be increased.

According to U.S. Pat. No. 3,994,771 a layered paper web is produced having improved properties with respect to bulk and surface softness, a web of softwood pulp being combined with a web of hardwood pulp to produce a composite paper web. This is then subjected to embossing by means of an embossing wire before it is caused to pass a through-blow dryer. The increase in bulk is stated to be caused by a re-orientation and penetration of the fibers on the side of the web facing the embossing wire into the mesh openings in the embossing wire.

U.S. Pat. No. 3,476,644 describes a method of improving the bulk softness by double-creping the paper web with the creping pattern oriented diagonally across the web.

According to U.S. Pat. Nos. 4,000,237 and 4,166,001, double creping is performed by first adhering the web by one side to a first creping roll and then creping it off, and afterwards adhereing the web to a second creping roll and then creping it off. The paper web is thus creped on both sides.

U.S. Pat. No. 3,903,342 describes a single-ply but laminate-like fibrous web in which the fiber concentration is greater in the surface regions than in the core, the fibers in the surface regions being held together by a binding agent which at some spaces also forms bridge portions of binding agent between the surface layers via the core. When the fibrous web is creped, cavities are produced in the core since this contains less fibers and is free from binding agent between said bridge portions. Thereby the web receives increased bulk and bulk softness. A similar fibrous web is described in the U.S. Pat. No. 4,166,001 mentioned above.

It is also known to introduce thermoplastic expandable microspheres in paper, see for instance U.S. Pat. Nos. 3,293,114 and 3,556,934, in order to improve the properties of the paper giving it lower grammage and greater stiffness. The increased stiffness and the treatment of the paper web otherwise obviously means that the finished product is not suitable for use as facial tissue paper or other sanitary paper articles.

SE Pat. No. 300 927 describes a process in which expanded plastic beads are added to a fibrous stock before this is spread onto the fourdrinier former for dewatering. However, problems arise in achieving sufficient retention between the cellulose fibers and satisfactory dispersion of the plastic beads in the stock to enable a uniform paper to be produced. The finished paper will therefore be distinctly two-sided, since the polymer particles which do not undergo expansion will to a great extent collect on the side of the paper facing away from the wire. Furthermore, the surface of the finished paper will contain blisters or foam particles from the plastic and special surface treatment such as surface sizing, is thus required. This means that the process is further disqualified for the purpose of manufacturing sanitary paper. U.S. Pat. No. 3,941,634 describes a method of avoiding these problems by introducing expandable thermoplastic beads between two partially dewatered webs of cellulose fibers and thereafter pressing the webs together and drying them at a temperature causing the beads to expand. However, both the latter methods produce and are intended to produce a paper having low grammage but retaining the duty properties of a heavier paper, such as stiffness among other things. Examples of such heavier paper are writing paper and paperboard.

The object of the present invention is to provide a new sanitary paper web and a new method of manufacturing such a sanitary paper web having high bulk, bulk softness and surface softness.

The sanitary paper web according to the invention is substantially characterised in that it contains expanded microspheres of thermoplastic material in an amount of from 1 to 10% based on the weight of the dry web.

In a preferred embodiment of the invention a greater proportion of the microspheres are located in a central region seen in the direction of thickness of the web, the web being preferably multi-layered, and comprising two surface layers and at least one inner layer in which the main proportion of the microspheres are located. In this connection it is preferred that the pulp fibers in the surface layers are derived mainly from hardwood and those in the inner layer mainly from softwood.

The size of the expanded microspheres may vary within wide limits, however, according to a suitable embodiment at least 90% of the expanded microspheres have a size within the range of 10–100 μm.

The new sanitary paper web is manufactured according to the present invention by first forming a sanitary paper web containing microspheres of thermoplastic material expandable by heating, in an amount from 1 to 10% calculated on the weight of dry fibers in the web, dewatering stock in the wet end of a paper machine, said stock containing an equivalent amount of said expandable microspheres, and thereafter, while retaining a considerable proportion of the bulk of the sanitary paper web formed, transferring the web from the wet end to the drying section of the paper machine and there drying the formed sanitary paper web containing the expandable microspheres at a temperature and for a period of time sufficient to expand at least the main proportion of the microspheres, thus imparting increased bulk, increased bulk softness and increased surface softness to the sanitary paper web. The sanitary paper web is then preferably dried on a Yankee cylinder from which the web is creped off. In order to obtain a sanitary paper web with expanded microspheres within the stated size range, one starts with expandable microspheres having a size of 5–30 μm, the proportion of such microspheres being 90%.

The manufacture of a sanitary paper web, using expandable microspheres in accordance with the present invention, has surprisingly been found to result in an improved bulk softness and surface softness in addition to improved bulk. The unexpected effects of the use of expandable microspheres in the manner described is assumed to depend on the fact that fiber bonds are prevented in a favourable manner when the sanitary paper web passes through the drying section of the paper machine and the microspheres thereby expand. During this expansion of the microspheres the fibers are forced to move from each other so that a great number of bonds between the fibers are prevented. Due to the reduction in the number of fiber bonds, the fibers become more movable in relation to each other which means that the web is perceived to be softer while achieving enhanced bulk. Furthermore, due to the reduction in the number of fiber bonds effected by the expansion of the microspheres, and the moving about of the fibers in the web, some of the fiber ends at the surfaces of the web will be directed outwardly therefrom and protrude to a greater or lesser extent from the surfaces so that the web will therefore be perceived as softer when the fingertips are brushed over the web and come into contact with the soft, flexible fiber ends protruding therefrom. The fiber ends protruding from both sides of the web also contribute enhanced bulk. The enhanced bulk is thereby the result of three separate effects, viz. by the increase in volume obtained when the microspheres are expanded, by the prevention of fiber bonds so that the distance between the fibers can be increased, and by the somewhat increased thickness of the web due to the protruding fiber ends.

Any type of expandable thermoplastic microspheres may be used, provided they expand at the drying temperatures occurring in the manufacture of paper. Examples of such expandable microspheres are plastic beads with casings prepared from a copolymer of vinylidene, chloride and acrylonitrile containing 10–35 percent by weight acrylonitrile based on the copolymer, the plastic beads containing isobutane which when heated to 80°–110° C. is converted to gaseous form so that the casings expand. Such a product is marketed by Kema-Nord Plastics, Sundsvall, Sweden, under the trademark EXPANCEL ®. In expanded condition, these microspheres have an average diameter of 10 μm which increases to 40 μm when heated, thus producing 60 times increment of the original volume.

Examples of other expandable thermoplastic microspheres suitable for the manufacture of sanitary paper according to the present invention are polymethyl metacrylate or copolymers of methyl metacrylate and monomers copolymerizable therewith, wherein the amount of methyl metacrylate should exceed 70 percent by weight based on the copolymer, and polystyrene or copolymers of styrene and monomers copolymerizable therewith, wherein the amount of styrene should exceed 70 percent by weight based on the copolymer. Other examples of useful microspheres are given in U.S. Pat. No. 3,293,114.

The invention will be described further in the following with reference to the accompanying drawings and a number of examples.

Figure 1:
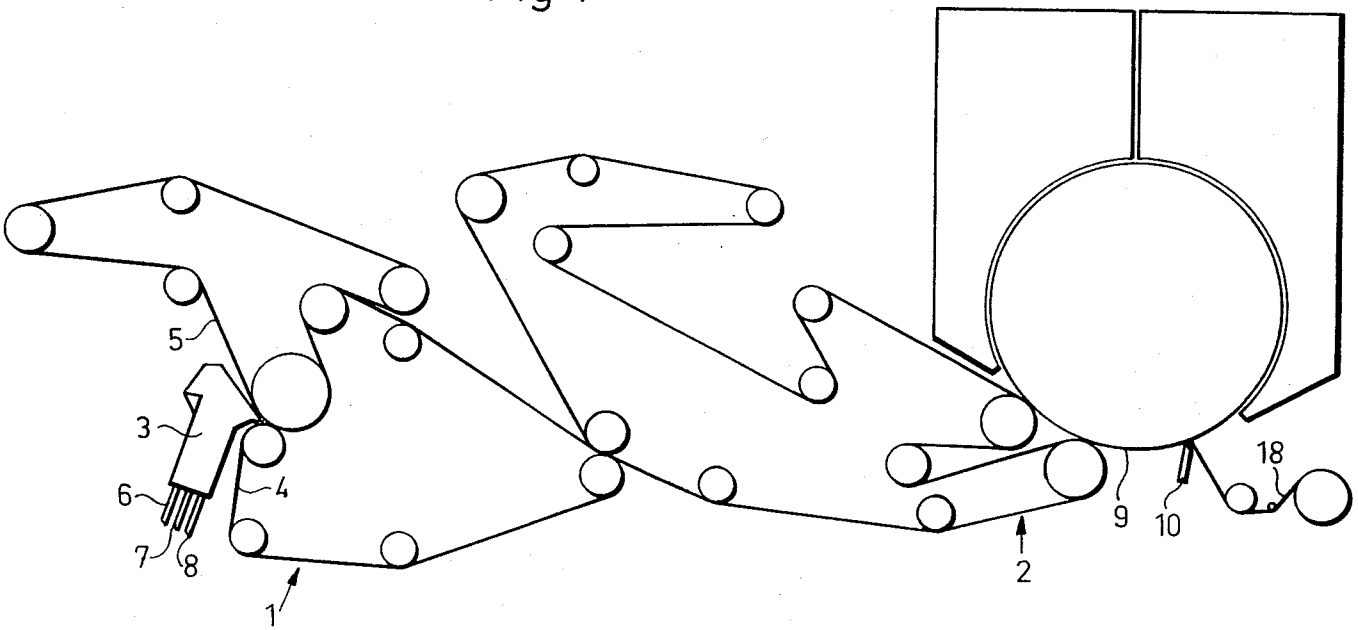
FIG. 1 illustrates schematically a paper machine for the manufacture of a sanitary paper web according to the invention.

With reference to FIG. 1 it is schematically shown therein essential sections and parts of a paper machine suitable for manufacturing tissue paper and other sanitary paper products. The tissue machine comprises a wet end 1 and a drying section 2, a head box 3 being included in the wet end, said head box delivering a multiple layer flow of stock between two movable forming wires 4, 5 for forming a sanitary paper web by dewatering the stock. In the embodiment shown, three stocks flow through the head box 3, separated from each other, and are sprayed out as a three-layer stock jet. The stocks flow into the head box from transverse distributers, through rows of tubes or pipes 6, 7, 8, respectively. According to a preferred embodiment of the invention, the stock to form the central layer contains expandable thermoplastic microspheres in a predetermined amount and uniformly distributed in the stock. Considerable quantities of water are removed in the wet end of the paper machine when the stocks are dewatered through the outer of the wires 4, 5, in relation to a forming roll having a smooth surface. A multi-layered paper web 18 is thus obtained, the web then being transferred to the drying section 2 while retaining a considerable proportion of the bulk of the sanitary paper web formed. The drying section comprises a Yankee cylinder 9 from which the sanitary paper web is creped off by means of a creping blade 10 in order to obtain the desired degree of creping. When the sanitary paper web passes through the drying section, the microspheres contained in the central layer will expand due to the heat supplied, the temperature and period of passage through the drying section being so selected in relation to each other to be sufficient and suitable to expand at least a main proportion of the microspheres to break fiber bonds as described earlier.

The invention is further illustrated by the following examples.

EXAMPLE 1

In a test with expanded microspheres of the type described above in a sanitary paper web, this was manufactured of three layers, the two outer layers consisting of hardwood pulp (HW) and the central layer of softwood pulp (SW) . Each of the outer layers constituted 25% and the central layer 50% of the web. The test was repeated with varying amounts of microspheres which were mixed homogenously into the stock for the central layer. The paper web was produced under conventional conditions of operation used in the manufacture of tissue and similar sanitary paper webs. The results obtained have been compiled in Table I below.

TABLE I

| | RUN | | | | |
|---|---|---|---|---|---|
| | 1 | 2 | 3 | 4 | 5 |
| Microspheres in finished web, % | 0 | 0.6 | 2.1 | 3.4 | 5.7 |
| Grammage, g/m$^2$ | 29.3 | 30.0 | 28.7 | 25.4 | 25.1 |
| Thickness, μm, at 0.2 N/cm$^2$ | 120 | 125 | 135 | 125 | 145 |
| Bulk, m$^3$/kg × 10$^{-3}$ | 4.09 | 4.16 | 4.70 | 4.92 | 5.78 |
| Surface softness*, upper side | 8.9 | 7.9 | 9.6 | 9.1 | 12.1 |
| Surface softness, lower side | 11.7 | 12.7 | 12.3 | 10.4 | 13.3 |
| Tensile Index $\sqrt{MD \times CD}$, Nm/g | 18.3 | 17.8 | 15.4 | 12.3 | 10.7 |
| Stiffness Shirley**, $\sqrt{MD \times CD}$, Nm × 10$^{-3}$ | 40.4 | 46.2 | 45.1 | 35.6 | 29.3 |

*The higher the value, the softer the product
**Stiffness Shirley = bending stiffness according to Shirley As is apparent from the above results, a considerable increase in bulk and a considerable increase in surface softness on both the upper and lower sides were obtained. It is further evident that the values based on tensile strength and bending stiffness decreased in a favourable manner.

Figure 2:
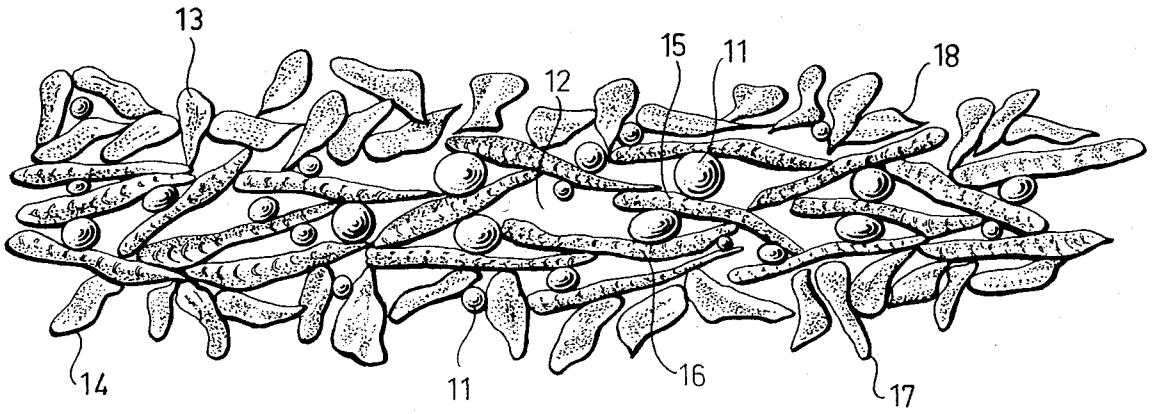
FIG. 2 is a longitudinal section through an enlarged section of a sanitary paper web manufactured in accordance with the invention.

FIG. 2 shows a longitudinal section of an enlarged portion of a sanitary paper web 18 manufactured in accordance with Example 1. The web contains expanded microspheres 11 which are concentrated to the central region 12, but which also appear in the two surface regions 13, 14. This enlargement shows that fibers 15, 16 have been forced to move from each other and that fiber bonds have been prevented by the microspheres 11 having expanded to a considerably greater volume. It can also be seen that fiber ends 17 protrude from the surface regions and are exposed for contact.

EXAMPLE 2

The test was repeated, with the difference that the two outer layers of the paper web consisted of softwood pulp (SW) and the central layer of hardwood pulp (HW). Each of the outer layers constituted 25% and the central layer 50% of the web. The results obtained have been compiled in Table II below.

TABLE II

| | RUN | | | | |
|---|---|---|---|---|---|
| | 1 | 2 | 3 | 4 | 5 |
| Microspheres in finished web, % | 0.4 | 0.7 | 2.1 | 3.7 | 5.9 |
| Grammage, g/m$^2$ | 26.9 | 27.6 | 26.5 | 25.9 | 25.5 |
| Thickness, μm, at 0.2 N/cm$^2$ | 120 | 125 | 130 | 145 | 155 |
| Bulk, m$^3$/kg × 10$^{-3}$ | 4.46 | 4.53 | 4.90 | 5.6 | 6.08 |
| Surface softness*, upper side | 6.1 | 6.8 | 6.2 | 5.9 | 7.4 |
| Surface softness, lower side | 8.7 | 8.3 | 7.8 | 7.7 | 6.4 |
| Tensile Index $\sqrt{MD \times CD}$, Nm/g | 18.4 | 17.8 | 15.6 | 14.3 | 11.9 |
| Stiffness Shirley**, $\sqrt{MD \times CD}$, Nm × 10$^{-3}$ | 32.3 | 36.1 | 31.7 | 42.3 | 36.3 |

*The higher the value, the softer the product
**Stiffness Shirley = bending stiffness according to Shirley The results show that in this case too, a considerable increase in bulk and an increase in surface softness on the upper side of the sheet were obtained. It is also evident that the values based on tensile strength and bending stiffness decreased in a favourable manner, and remained at an acceptable level, respectively.

The method according to the invention can also be used to produce a two-layered sanitary paper web, in which case the microspheres are in the stock layer nearest to the inner wire and move towards the outer wire during the dewatering process. It is also possible to form a single-layered sanitary paper web of a stock in which the microspheres are dispersed in a predetermined amount.

The method according to the invention is intended to make blow-through drying superfluous, however, it can be combined with this type of blow-through drying, if desired. It is also possible to combine the method with other process technical measures to increase bulk, bulk softness and surface softness. The drying section may, for instance, comprise two Yankee cylinders arranged in tandem, the sanitary paper web being adhered first by one side to the first Yankee cylinder, being creped off this and then adhered by the other side to the second Yankee cylinder and creped off this in order to obtain a double-sided creping. However, one of the main objects of the invention is that such costly measures can be avoided since the resultant sanitary paper web has in any case considerable bulk, bulk softness and surface softness.

The expression "high bulk" of the sanitary paper web according to the invention relates normally to values of about 4.0 m$^3$/kg×10$^{-3}$ and above.

I claim:

1. A sanitary paper web having high bulk, bulk softness and surface softness, and comprising a creped sanitary paper web and expanded microspheres of thermoplastic material incorporated therein in an amount from 1 to 10% based on the weight of the dry web, said web having a high bulk value of at least about $4.0\times10^{-3}$ $m^3/kg$.

2. A creped sanitary paper web according to claim 1, wherein a major proportion of the microspheres is located in a central region of the web when viewed in the direction of the thickness of the web.

3. A creped sanitary paper web according to claim 2, wherein the web is multi-layered, and comprises two surface layers and at least one inner layer in which the major proportion of the microspheres is located.

4. A creped sanitary paper web according to claim 3, wherein the pulp fibers in the two surface layers are derived mainly from hardwood and those in said inner layer are derived mainly from softwood.

5. A creped sanitary paper web according to any one of claims 1–4, wherein at least 90% of the expanded microspheres have a size in the range from about 10–100 μm.

6. A method of manufacturing a sanitary paper web having high bulk, bulk softness and surface softness comprising the steps of forming a slurry of fibrous stock containing microspheres of thermoplastic material expandable by heating, in an amount of from 1 to 10% based on the weight of dry fibers in the web to be formed, dewatering the slurry in the wet end of a paper machine to form a sanitary paper web, and thereafter, while retaining a considerable proportion of the bulk of the sanitary paper web thus formed, transferring the web from the wet end to the drying section of the paper machine and there drying the sanitary paper web containing the expandable microspheres on a Yankee cylinder dryer at a temperature and for a period of time sufficient to expand at least a main proportion of the microspheres while preventing additional fiber bonds and creping the sanitary paper web off of the Yankee cylinder to thereby provide a creped sanitary paper product having enhanced bulk, enhanced bulk softness and enhanced surface softness and a bulk value of at least about $4.0\times10^{-3}$ $m^3/kg$.

7. A method according to claim 6 wherein a major proportion of the microspheres is located in a central region of the web when viewed in the direction of the thickness of the web.

8. A method according to claim 7, wherein said web is multi-layered and comprises two surface layers and at least one inner layer, in which a major proportion of the microspheres is located.

9. A method according to claim 8, wherein hardwood pulp fibers are used for the two surface layers and softwood pulp fibers are used for said inner layer.

10. A method according to claim 7, wherein the step of dewatering the slurry to form a sanitary paper web comprises dewatering a multi-layered stock flow from a multiple layer head box between two forming wires.

11. A method according to claim 6, wherein at least 90% of the expandable microspheres have a size in the range from about 5–30 μm.

12. A method according to claim 7, wherein the step of dewatering the slurry to form a sanitary paper web comprises dewatering a multi-layered stock flow between an outer forming wire and an inner felt in a curved forming zone of a twin-wire paper machine and wherein the inner layer of the flow in relation to the curvature of the forming zone contains the expandable microspheres.

* * * * *